United States Patent [19]

Wimberley

[11] 4,426,916

[45] Jan. 24, 1984

[54] VARIABLE DISPLACEMENT MOTOR

[76] Inventor: Lewis L. Wimberley, Box 132, Barksdale, Tex. 78828

[21] Appl. No.: 274,785

[22] Filed: Jun. 18, 1981

[51] Int. Cl.[3] ..... F01B 3/00

[52] U.S. Cl. ..... 92/32; 92/33; 92/136; 74/129; 192/48.92

[58] Field of Search ..... 74/128, 129, 810, 812; 192/48.92; 92/33, 32, 3, 136, 138, 165 PR

[56] References Cited

U.S. PATENT DOCUMENTS

| | | | |
|---|---|---|---|
| 829,279 | 8/1906 | Mears | 92/33 |
| 2,387,908 | 10/1945 | Howard | 74/60 |
| 3,183,792 | 5/1965 | Allen | 92/136 |
| 3,964,323 | 6/1976 | Seibert | 74/60 |
| 4,077,269 | 3/1978 | Hodgkinson | 74/60 |
| 4,196,654 | 4/1980 | Stearns | 92/33 |
| 4,300,641 | 11/1981 | Kinkel | 92/33 |

OTHER PUBLICATIONS

Lindsley, E. F., "Traction-Drive Transmission" 3/1980, *Popular Science,* p. 83.

*Primary Examiner*—Robert E. Garrett

*Assistant Examiner*—Richard S. Meyer

*Attorney, Agent, or Firm*—Gunn, Lee & Jackson

[57] ABSTRACT

The present invention converts longitudinal motion into rotary motion. A reciprocating piston (that may receive a motive force from any desired means) oscillates longitudinally on a drive shaft. Extending through the piston parallel to the drive shaft is at least one ratchet pin that has a sprague clutch attached thereto by a ratchet arm for turning the drive shaft in one rotary direction. Also extending through the piston is at least one angle pin anchored in each end of a housing for the piston, which angle pin is at a slight angle with respect to the drive shaft and the ratchet pin. The slight angle causes the ratchet pin to arcuately move back and forth as the piston oscillates longitudinally. The arcuate movement of the ratchet pin causes the sprague clutch to turn the drive shaft. An adjustment of the slight angle may be provided to infinitely vary ratios of longitudinal movement to arcuate movement. By including two ratchet pins with sprague clutches, two angle pins, and a multilayered piston, the drive shaft can be driven for both directions of longitudinal movement of the multilayered piston.

11 Claims, 8 Drawing Figures

VARIABLE DISPLACEMENT MOTOR

BACKGROUND OF THE INVENTION

The present invention relates to a variable displacement motor and, more particularly, to a motor that converts longitudinal motion to rotary motion. A piston simultaneously reciprocates longitudinally along a drive shaft and rotates back and forth as the piston reciprocates. The turning rotary motion of the piston operates a ratchet with a sprague clutch that turns the drive shaft. By the use of multilayered pistons and multiple sprague clutches, the drive shaft can be turned during both directions of longitudinal and rotary movement of the piston.

BRIEF DESCRIPTION OF THE PRIOR ART

Prior to the present invention, many different types of devices have been used to convert longitudinal motion into rotary motion. The most common of these devices is the wobble plate, which is frequently used in air conditioning systems. Other devices in the past have used variations of the wobble plate design with Howard (U.S. Pat. No. 2,387,908) being a typical wobble drive device.

Other devices that utilize the same principle as the wobble plate have an offset shaft driven by a wobbler mechanism, such as shown in Seibert (U.S. Pat. No. 3,964,323). Another variation of the wobble plate design that provides for variable displacement is shown in Hodgkinson (U.S. Pat. No. 4,077,269).

However, none of the devices as referred to hereinabove utilizes the concept as covered by the present invention of simply taking a reciprocating piston and directly driving from the reciprocating piston a drive shaft. None of the prior art shows a reciprocating piston that reciprocates back and forth along a drive shaft while simultaneously rotating back and forth in a manner to drive the drive shaft by a ratchet type mechanism with a sprague clutch.

The closest prior art known by applicant is contained in *Popular Science,* March, 1980, on page 83, in an article entitled "Traction-Drive Transmission" by E. F. Lindsley. In the article by Mr. Lindsley, a diagram is shown for an infinitely variable ratio transmission to vary from maximim torque at minimum speed to minimum torque at maximum speed. However, this device does not have a zero speed or neutral. As can be quickly seen from the illustrations contained on page 85 of the article, the apparatus as contained in the article by Lindsley is considerably different than the subject invention.

SUMMARY OF THE INVENTION

It is an object of the present invention to provide an apparatus for converting longitudinal motion into rotary motion.

It is another object of the present invention to utilize the motion of a reciprocating piston to directly cause rotary motion of a drive shaft.

It is a further object of the present invention to utilize the motion of a reciprocating piston by simultaneously causing oscillatory rotary motion of the piston with the longitudinal motion, which oscillatory rotary motion is used to drive a ratchet type mechanism that turns the drive shaft.

It is still another object of the present invention to utilize high volume, low pressure fluid to cause reciprocating motion of a piston and still generate maximum torque when converting the reciprocating motion of the piston to rotary motion of a drive shaft.

In the present invention, a free floating piston is maintained inside of a cylindrical type housing with a drive shaft extending into one end of the cylinder. The piston moves back and forth along the drive shaft with any particular desired motive force being utilized. A typical motive force would be applying high volumes of low pressure fluid alternately on each side of the free floating piston to cause the piston to move back and forth.

As the piston moves back and forth in a longitudinal manner along the drive shaft, an angle pin also extends through the piston between each end of the cylindrical housing at a slight angle with respect to a vertical plane extending longitudinally through a plane which includes a center line of the cylindrical housing and intersects the angle pin. Also extending through the piston parallel to the drive shaft is a ratchet pin which is connected on each end thereof to the drive shaft by means of sprague clutches. Therefore, as the piston moves back and forth along the drive shaft, the angle of the angle pin causes the piston to oscillate in a rotary manner. The rotary oscillation of the piston drives the ratchet pin, which in turn drives the sprague clutches to turn the drive shaft. It should be realized that the sprague clutches act in much the same manner as a ratchet, which causes the drive shaft to turn only during rotary motion of the piston in one direction, but not the other. By utilizing multilayered pistons and at least two angle pins and ratchet pins, the drive shaft can be turned by rotary motion of the piston when moving in either direction.

An alternative feature is to provide an adjustment for the angle pin whereby the angle pin can be positioned from parallel with the drive shaft and ratchet pin (neutral) to a postiion of a maximum angle differential therebetween. This provides an infinitely variable ratio between the longitudinal motion of the piston and the rotary motion of the drive shaft. When the angle pin is parallel to the drive shaft and ratchet pin, the motor is in neutral or idle position and provides no output rotary motion. By a small movement of the angle pin to a very small angle with respect to the ratchet pin, the maximum torque output is provided by the drive shaft. The greater the angle, the greater the speed of the drive shaft, but the lower the torque.

In another alternative embodiment, the free floating piston has three layers with the outer two layers being rigidly connected to a cylindrical flange that prevents binding as the piston moves back and forth in the housing. The center layer of the piston is free to rotate back and forth between the two outer layers. One layer of the piston causes the ratchet motion of the ratchet pin to turn the drive shaft as the piston moves in one direction, another layer of the piston causes another ratchet pin to turn the drive shaft in the same direction when the piston is going in the opposite direction. This allows for basically continuous drive of the drive shaft due to movement of the piston in either direction.

It may be necessary to allow for radial adjustments of the opening receiving the angle pins therethrough by having sockets carried by flange members in slotted opening of the multilayered piston. This allows one side of the piston to be sealed from the other, but at the same time permits the angle of the angle pins to be adjustable.

DESCRIPTION OF THE PREFERRED EMBODIMENT

Figure 1:
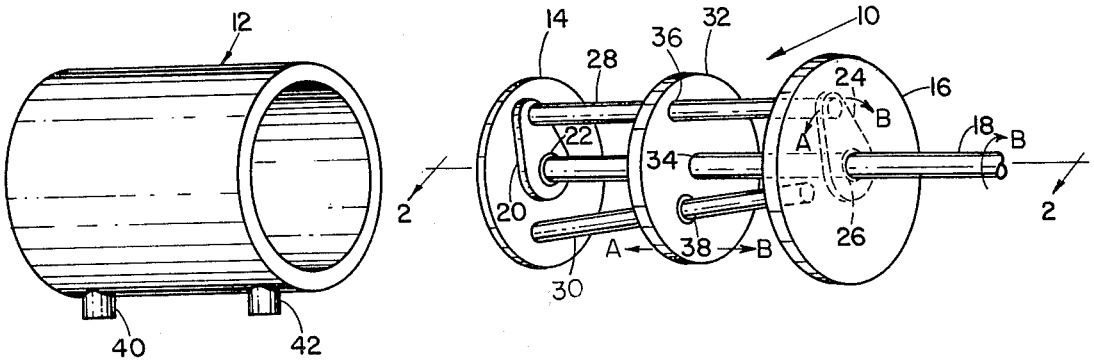
FIG. 1 is a perspective view with a housing being exploded from a displacement motor embodying the present invention, which motor is shown in its simplest form.

Referring to FIG. 1, there is shown the simplest version of a displacement motor incorporating the present invention, which motor is represented generally by reference numeral 10 with the cylindrical housing 12 removed. Left end plate 14 and right end plate 16 would be connected to the cylindrical housing in the assembled position by any convenient means in a leakproof manner. For the purpose of illustration of the present invention, seals and bearings have not been included, but would obviously be included in the assembled version. Extending through the right end plate 16 is a drive shaft 18. The drive shaft 18 is free to rotate within the left and right end plates 14 and 16 by which drive shaft 18 is supported. The drive shaft 18 is located along the center line of the displacement motor 10 and the cylindrical housing 12 (when assembled).

Also mounted on drive shaft 18 immediately inside the left end plate 14 is a left end clockwise ratchet arm 20 with a sprague clutch 22 carrying the left end clockwise ratchet arm 20 on the drive shaft 18. Mounted on drive shaft 18 immediately inside of the right end plate 16 is a right end clockwise ratchet arm 24 with a sprague clutch 26 carrying the right end clockwise ratchet arm 24 on the drive shaft 18. Carried between the ratchet arms 24 and 26 is a ratchet pin 28. The ratchet pin 28 is physically connected to the ratchet arms 20 and 24 by any convenient means. Mounted on each end thereof in left end plate 14 and right end plate 16 is angle pin 30.

Carried between the end plates 14 and 16 and parallel thereto is a free floating piston 32. The free floating piston 32 may slide longitudinally along drive shaft 18, which drive shaft 18 extends therethrough by means of opening 34. Also free floating piston 32 may slide along ratchet pin 28 by means of opening 36. Also, free floating piston 32 may move along angle pin 30, which extends through a rotatable socket 38 mounted in free floating piston 32.

Figure 2:
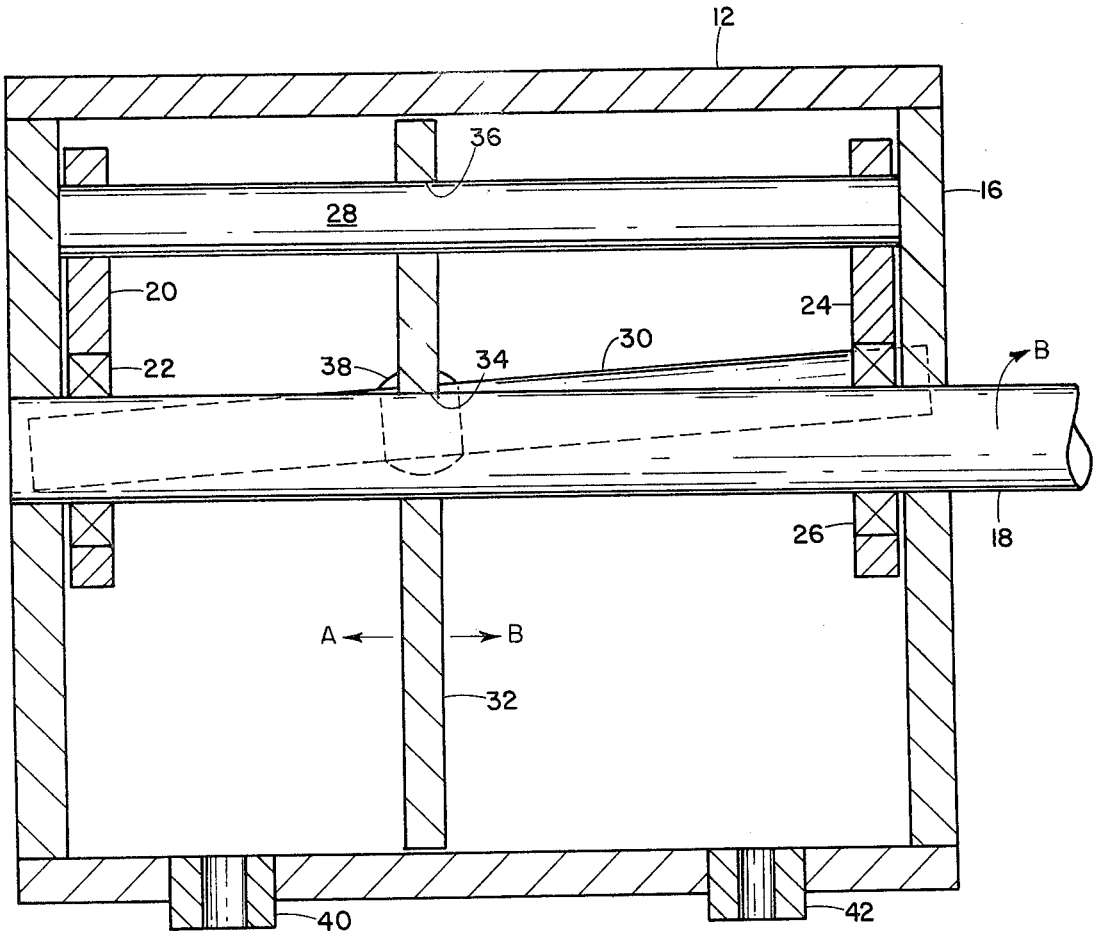
FIG. 2 is a cross-sectional view of FIG. 1 along section lines 2—2 with the housing in position.

Referring now to FIG. 2, the same numerals as previously used in conjunction with the description of FIG. 1 will further be utilized in explaining the cross-sectional view. In FIG. 2, the cylindrical housing 12 has been assembled over the displacement motor 10. Towards the left end of the cylindrical housing 12 is a left end inlet/output 40 and towards the right end of the cylindrical housing 12 is a right end inlet/outlet 42. While many different methods may be utilized to move the free floating piston 32 back and forth in a reciprocating manner, in the description of the simplest form of the present invention, a lower pressure fluid will alternately be applied to the left and righthand sides of the free floating piston 32 via left and right end inlet/outlets 40 and 42. The mechanism for controlling the low pressure fluid has not been shown and is standard in the industry. By first applying a low pressure fluid at the right end inlet/outlet 42, the free floating piston 32 will be moved to the left as indicated by the arrow A. Simultaneously this will cause the left end clockwise ratchet arm 20 and the right end clockwise ratchet arm 24 to turn in the direction as indicated by the arrow A as can be more clearly seen in FIG. 1. Since the sprague clutches 22 and 26 are designed for clockwise movement when viewed from the righthand end of FIG. 1 or 2, no rotary motion is applied to the drive shaft 18. The angle between the angle pin 30 and the ratchet pin 28 causes the rotary movement of the ratchet arms 20 and 24.

However, upon removing the low pressure fluid through right end inlet/outlet 42 and applying the low pressure fluid to the left end inlet/outlet 40, the free floating piston 32 moves to the right in the direction indicated by the arrow B. Again, due to the angle between the ratchet pin 28 and the angle pin 30, the ratchet pin 28 and the ratchet arms 20 and 24 are rotated in the direction indicated by the arrow B. This rotary motion in the clockwise direction now causes sprague clutches 22 and 26 to engage drive shaft 18 causing it to rotate in a clockwise manner as indicated by the arrow B.

As shown in the simplest version illustrated by FIGS. 1 and 2, movement of the free floating piston 32 in a longitudinal direction indicated by arrow A will have no effect on the drive shaft 18; however, upon moving the free floating piston 32 in the direction indicated by the arrow B will cause the drive shaft 18 to rotate in a clockwise direction. In actual operation, the drive shaft 18 would coast while the free floating piston 32 moves in the direction A, but would have rotary force applied as the free floating piston 32 moves in the direction indicated by arrow B. Particularly note that the free floating piston 32, due to the angle created by the angle pin 30, rotates slightly as it moves back and forth along the drive shaft 18. It is this rotary motion of the free floating piston 32 that is being used to apply rotary force the drive shaft 18 during one direction of its movement via the ratchet pin 28, ratchet arms 20 and 24, and sprague clutches 22 and 26.

It should be realized that the displacement motor shown in the simplest embodiment of FIG. 1 is not variable and is used merely to illustrate the principle of converting longitudinal movement to a rotary drive. It further should be understood that any convenient means of providing longitudinal movement to the piston 32 could be utilized. None of the seals or bearings as would normally be used have been shown in this pictorial illustration. Further, if the angle pin 30 has a tendency to bind if straight, the angle pin 30 could have a slight helical twist to prevent binding. The slight helical twist would maintain the distance between the center line of the drive shaft 18 and the center line of the angle pin 30 when cut by a perpendicular plane. However, because of the smallness of the angle between angle pin 30 and the drive shaft 18, the helical twist is not necessary.

Figure 3:
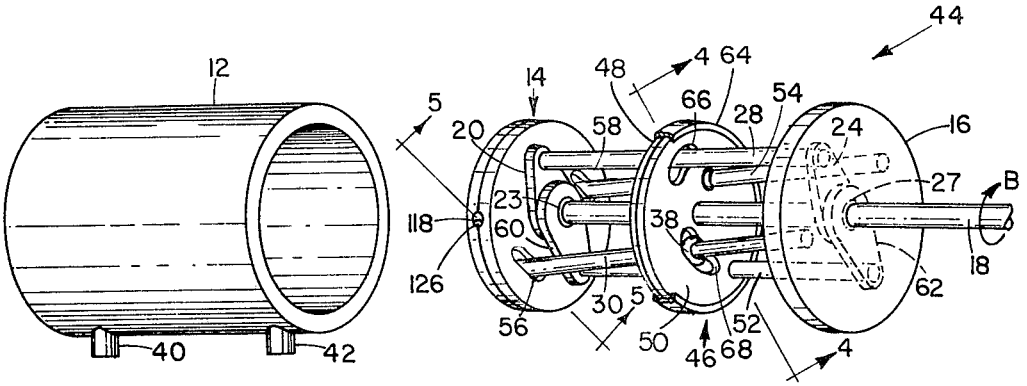
FIG. 3 is an exploded perspective view of another embodiment of the displacement motor with the housing removed, the displacement motor being infinitely variable and driving the drive shaft with both directions of longitudinal motion of the piston.

Referring now to FIG. 3, a more complicated version of the displacement motor 10 is shown, which more advanced version is represented generally by reference numeral 44. Where applicable, the same numerals as used in conjunction with FIGS. 1 and 2 will be utilized in conjunction with FIG. 3. Again, the cylindrical housing 12 is shown exploded away from the displacement motor 44. The displacement motor 44 again has angle pin 30, ratchet pin 28 and ratchet arms 20 and 24. Sprague clutches 23 and 27 are the same as the sprague clutches 22 and 26 (not shown in FIG. 3) inside of ratchet arms 20 and 24, respectively, as previously described in conjunction with FIG. 1. However, the free floating piston 32 of FIG. 1 has been replaced by a multilayered piston 46, which consists of a left layer 48 and a right layer 50. The left layer 48 is basically the same as the free floating piston 32 with a couple of additional slots therein (not shown in FIG. 3) to accomodate another ratchet pin 52 and angle pin 54.

In FIG. 3, the angle pins 30 and 54 are again mounted in the right end plate 16 and left end plate 14; however, the angles of angle pins 30 and 54 are adjustable in left end plate 14 in a manner as will be described in more detail in conjunction with FIG. 5. The slots for adjustment of the angle pins 30 and 54 can be seen in FIG. 3 as slots 56 and 58. The ratchet pin 52 is carried on ratchet arms 60 and 62. Ratchet arms 60 and 62 have sprague clutches 23 and 27 in the same manner as ratchet arms 20 and 24 described in conjunction with FIG. 1 so that if there is clockwise rotary motion of the ratchet arms 60 and 62 when viewed from the right end of displacement motor 44, the sprague clutches will engage the drive shaft 18.

Figure 4:
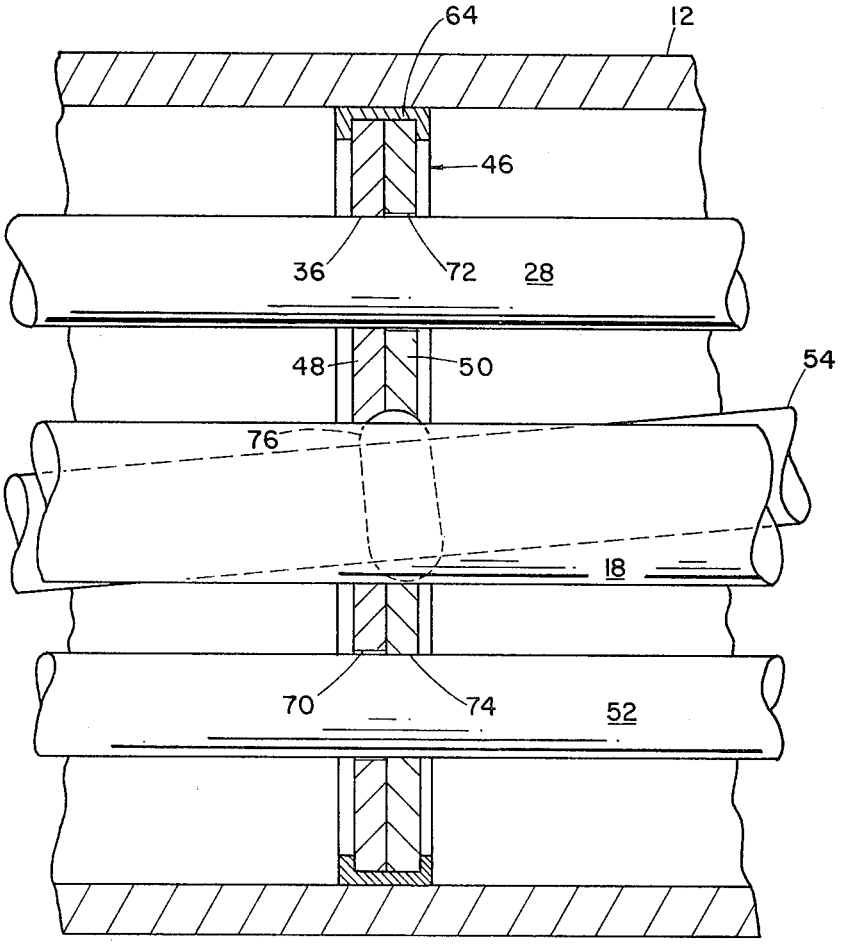
FIG. 4 is an enlarged partial cross-sectional view of FIG. 3 taken along section lines 4—4 showing the piston as contained in the housing.

The two layers 48 and 50 of the multilayered piston 46 are held together by a clamp ring 64 as can be more clearly seen in the partial cross-sectional view of FIG. 4. However, the left layer 48 is free to rotate with respect to the right layer 50 inside of the clamp ring 64. Assuming the cylindrical housing 12 was in place over the displacement motor 44 shown in FIG. 3, upon applying a pressurized fluid to the right end inlet/outlet 42, the multilayered piston 46 would move to the left. As the multilayered piston 46 moves to the left, the left layer 48 causes the ratchet pin 28 to rotate on the drive shaft 18, the amount of rotation being determined by the angle of the angle pin 30. The rotation of the left layer 48 has no effect in the right layer 50 because of the arcuate slots 66 and 68 contained in the right layer 50 of the multilayered piston 46. Movement of the left layer 48 of the multilayered piston 46 has no effect on ratchet pin 52 and angle pin 54; however, since the left layer 48 and right layer 50 of the multilayered piston 46 move together, the right layer 50 does control ratchet pin 52.

Right layer 50, due to the angle between angle pin 54 and ratchet pin 52, will cause the ratchet pin 52 to rotate back and forth as the right layer 50 (or the multilayered piston 46) reciprocates longitudinally along the drive shaft 18. While the sprague clutches of the ratchet arms 20 and 24 turn the drive shaft 18 in a clockwise manner upon the left layer 48 moving in a righthand direction, the sprague clutches 23 and 27 in ratchet arms 60 and 62 turn the drive shaft 18 in a clockwise direction upon right layer 50 of the multilayered piston 46 moving in a lefthand direction. Therefore, by using the multilayered piston 46 with the left layer 48 and right layer 50 controlling their respective ratchet pins 28 and 52, a driving force to the drive shaft 18 is provided by both directions of movement of the multilayered piston 46.

Referring now to FIG. 4, the left layer 48 has the previously described opening 36 for the ratchet pin 28, but has an arcuate slot 70 for ratchet pin 52. Right layer 50 in turn has an arcuate slot 72 for ratchet pin 28 and an opening 74 for ratchet pin 52. Also contained in layer 50 is rotatable socket 76 which is designed to receive angle pin 54 therethrough in the same manner that rotatable socket 38 receives angle pin 30 therethrough. Particularly note that the slot 68 shown in FIG. 3 is large enough to accomodate the rotatable socket 38, which is mounted in the left layer 48.

Figure 7:
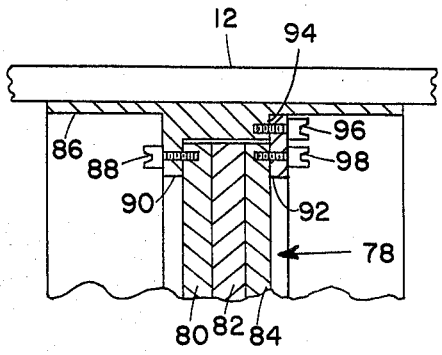
FIG. 7 is a partial sectional view of the multilayered piston shown in FIG. 6 as assembled inside of the housing.
Figure 6:
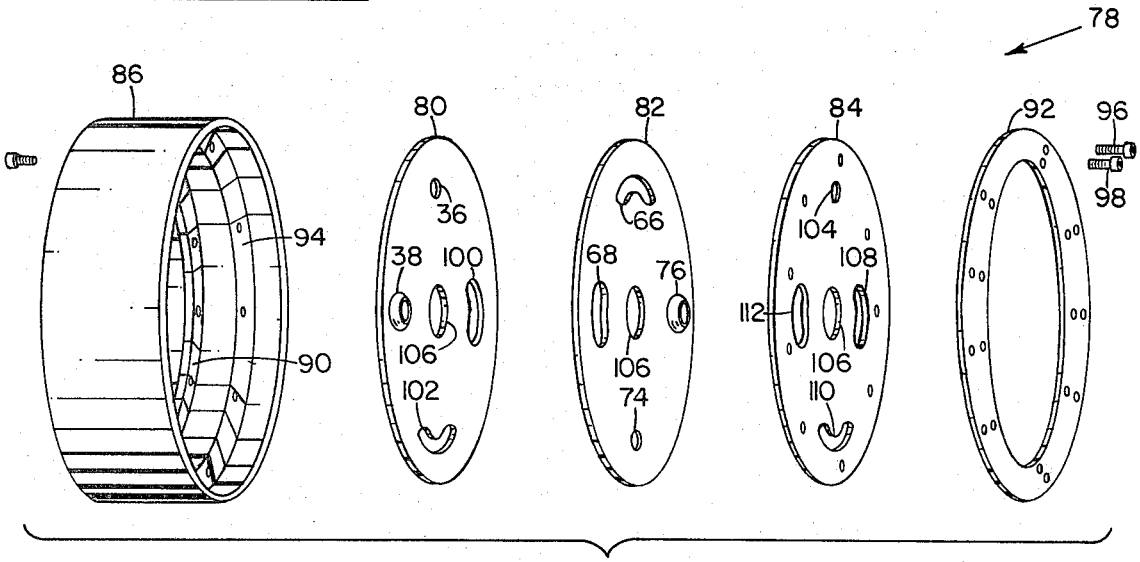
FIG. 6 is an exploded perspective view of an alternative embodiment of a multilayered piston that could be used in FIG. 3.

Referring now to FIGS. 6 and 7 in combination, a modified version of the multilayered piston 46 as shown in FIG. 4 will be explained. FIG. 7 shows a partial end sectional view of a triple layer piston 78 contained inside of cylindrical housing 12. The left layer 80 is identical to the previously described left layer 48 of FIGS. 3 and 4. The center layer 82 of FIGS. 6 and 7 is identical to the right layer 50 of previously described FIGS. 3 and 4. The right layer 84 of FIGS. 6 and 7 is used to provide additional support, backing and sealing for left layer 80 and center layer 82. Center layer 82 is free to rotate inside of left and right layers 80 and 84. Left layer 80 is connected to a cylindrical flange 86 by means of bolts 88 extending through a shoulder 90 thereof. The right layer 84 is also rigidly connected to cylindrical flange 86 by means of a retaining ring 92 being connected to a shoulder 94 by bolts 96 and to right layer 84 by bolts 98. Referring to the left layer 80, opening 36 and rotatable socket 38 are the same as previously described in conjunction with FIG. 1. However, left layer 80 also has arcuate slots 100 and 102.

Referring to the center layer 82 as shown in FIG. 6, it has the previously described opening 74, rotatable socket 76, and arcuate slots 66 and 68 as previously described for the right layer 50 of FIG. 3. However, the alternative embodiment of FIG. 6 also utilizes the right layer 84, which serves as a backing plate for additional strength and sealing which has an opening 104 in alignment with opening 36 of the left layer 80. All of the center openings designated by reference numeral 106 are in alignment. However, right layer 84 also has arcuate slots 108, 110 and 112 to prevent the right layer 84 from interferring with the rotating motion of center layer 82.

By utilizing the triple layer piston 78 as shown in FIGS. 6 and 7 in combination with the cylindrical flange 86, the triple layer piston 78 will not bind against the sides of the cylindrical housing 12 when it is reciprocating along the drive shaft 18. Also, the right layer 84 provides additional strength and helps prevent leakage from one side of the triple layer piston 78 to the other.

Figure 5:
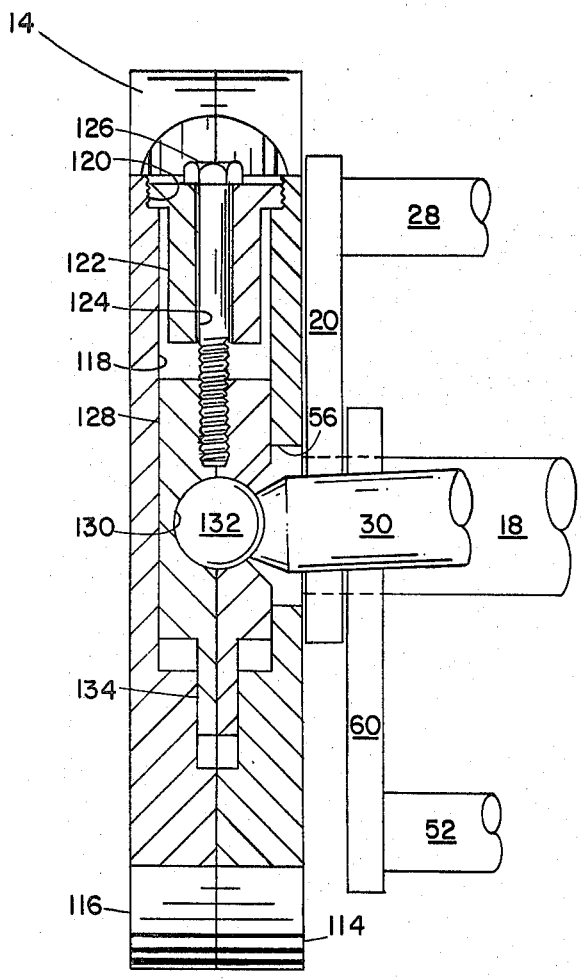
FIG. 5 is an enlarged partial sectional view of FIG. 3 taken along section lines 5—5 showing the end portion of the housing, but with the cylindrical portion of the housing being removed.

Referring now to FIG. 5, the left end plate 14 for the alternative embodiment as shown in FIG. 3 is given in a partial sectional view along section lines 5—5 of FIG. 3. It should be understood that the cylindrical housing 12 is not shown in the partial sectional view of FIG. 5.

The end plate 14 has an inside layer 114 and an outside layer 116. Located between inside layer 114 and outside layer 116 is an opening 118. In this particular embodiment, the opening 118 is designed to be a hole drilled into left end plate 114 with the upper portion being offset and having threads 120. Threaded into threads 120 is a flanged sleeve 122 with a center opening 124 located therein. Extending through the center opening 124 is bolt 126 that is used to adjust sliding block 128. The sliding block 128 has two halves with a spherical opening 130 being formed in the center thereof to act as a socket for the ball connection 132 on the end of angle pin 30. The sliding block 128 also has a guide member 134 at the lower end thereof.

By adjusting the bolt 126, the angle created by angle pin 30 is adjusted by adjusting the angle pin 30 in the slot 56 by moving the sliding block 128 and ball connection 132 up and down. By adjusting the angle pin 30 so that it is parallel to the drive shaft 18 and ratchet pin 28, the displacement motor 44 (see FIG. 3) has been changed to the neutral position. In the neutral position, longitudinal movement of the multilayered piston 46 will not cause any rotary motion of the drive shaft 18. However, upon the angle pin 30 being moved to the maximum angle differential with respect to ratchet pin 28, the maximum rotary motion for the least longitudinal motion is created, which output is at the minimum torque.

While it is not shown in connection with FIG. 5, it should be realized that the cylindrical housing 12 would be located over the left end plate 14 in a sealing manner to prevent leakage.

It should be understood that angle pin 54 may be adjusted in the same way as angle pin 30 described in conjunction with FIG. 5. While the adjustment for the angle pin 30 in FIG. 5 is shown as manual, it should be realized that the adjustment could also be automatic and controlled by any of a number of means, such as a hydraulic fluid. Regardless of the method of control of angle pin 30 with the manual method of control being shown for illustration purposes only, it should be clear that by varying the angle of angle pin 30, the output to drive shaft 18 is infinitely variable with respect to the displacement of the multilayered piston 46.

By having the output-to-input ratio infinitely variable, the torque on the output drive shaft 18 is also infinitely variable. This allows the variable displacement motor 44 as shown in FIG. 3 to accomodate all types of loads. The variable displacement motor as just described for FIG. 3 has the combined effects of a clutch, motor and transmission in one unit.

Figure 8:
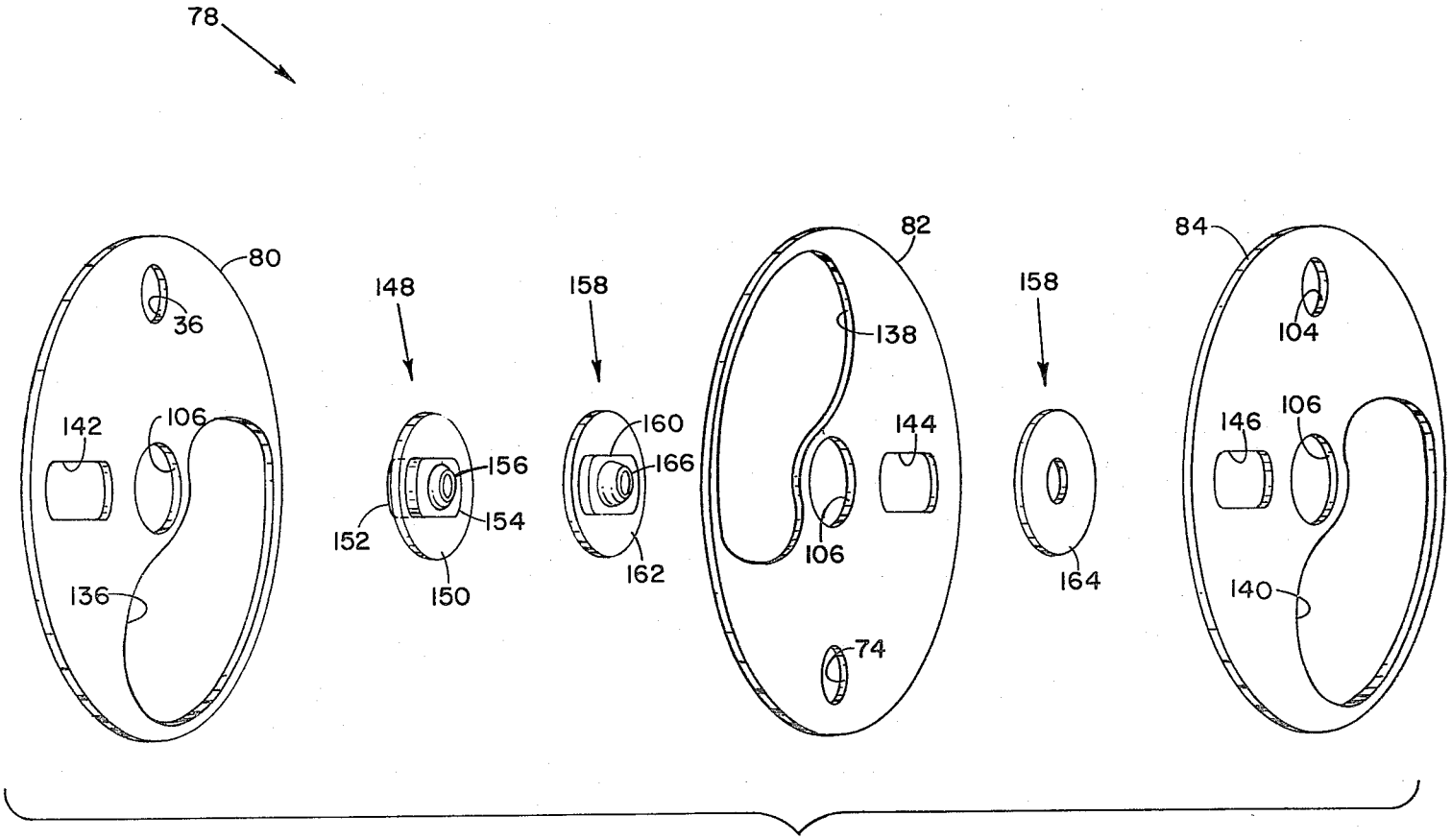
FIG. 8 is an exploded perspective view of yet another alternative embodiment of a multilayered piston that could be used in FIG. 3.

Referring now to FIG. 8 of the drawings, the triple layer piston 78 is shown in an alternative embodiment with the respective layers 80, 82 and 84 being shown in an exploded perspective view. Each of the layers 80, 82 and 84 have center opening 106 to receive the drive shaft 18 (explained in conjunction with prior Figures) therethrough. Also, left layer 80 has opening 36, center layer 82 has opening 74, and right layer 84 has opening 104. These function in the same manner as previously described in conjunction with FIG. 6. However, the arcuate slots 100 and 102 of left layer 80 have been replaced by enlarged clearance opening 136, arcuate slots 66 and 68 of center layer 82 have been replaced by enlarged clearance opening 138, and arcuate slots 108 and 110 of right layer 84 have been replaced by enlarged clearance opening 140.

Replacing the rotatable sockets 38 and 76 in left layer 80 and center layer 82, respectively, are radial slots 142 and 144, respectively. Also in right layer 84 is a radial slot 146. Contained inside of enlarged clearance opening 138 is an angle pin socket 148. The angle pin socket 148 has a center flange 150 which has a thickness approximately equal to the center layer 82. The center flange 150 is received inside of enlarged clearance opening 138. On either side of the center flange 150 are matching oblong shoulders 152 and 154. Oblong shoulder 152 is received inside of radial slot 142 and oblong shouler 154 is received inside of radial slot 146 of left layer 80 and right layer 84, respectively. The oblong shoulders 152 and 154 are narrow enough to slide freely inside of the radial slots 142 and 146, but not turn. The oblong shoulders 152 and 154 are not as long as the radial slots 142 and 146, therefore, they are free to move radially inward or outward if necessary as the angle pin 30 (see FIG. 3) is adjusted. Contained in the center of angle pin socket 148 is a rotatable socket 156, which is generally the same as the previously described rotatable socket 38. The angle pin 30 is received through the rotatable socket 156 if the multilayered piston of FIG. 8 was combined with the displacement motor 44 of FIG. 3.

An angle pin socket 158 has an oblong shoulder 160 that is received inside of radial slot 144 of center layer 82. The oblong shoulder 160 has a thickness approximately equal to the thickness of the center layer 82. On the left side of the oblong shoulder 160 (and on the left side of center layer 82 in the assembled position) is a left flange 162 that is received inside of enlarged clearance opening 136. On the right side of oblong shoulder 160 is a right flange 164, which is received inside of enlarged clearance opening 140 of right layer 82. (For the purposes of illustration only, right flange 164 is shown physically separated from oblong shoulder 160, but would be bonded thereto upon assembly to form one integral piece.) Extending through the oblong shoulder 160, left flange 162 and right flange 164, is a rotatable socket 166 which serves the same function as rotatable socket 76 previously described in conjunction with FIG. 6. When assembled, the oblong shoulder 160 of angle pin socket 168 is received inside of radial slot 144. The only movement of angle pin socket 158 would be radially outward or inward as necessary to accomodate adjustments to the angle pin 54 shown in FIG. 3.

By utilizing the triple layer piston 78 as shown in FIG. 8, any tendency of the angle pins 30 and 54 to cause binding due to a changing of the distance between the angle pins 30 and 54 and the drive shaft 18 has been eliminated by allowing for radial movement of the rotatable sockets 156 and 166 that receive the angle pins 30 and 54 therethrough. Also by having the thickness of the center flange 156 approximately equal to the center layer 82, and the thickness of the oblong shoulder 160 approximately equal to center layer 82, a good seal is still maintained. This seal would prevent the leakage of fluid from one side to the other of the triple layer piston 78.

While the present invention has been explained with the ratchet pins 28 and 52 being anchored in the ratchet arms 20 and 24, and 60 and 62, respectively, it should be realized that this could be changed with the angle pins 30 and 54 being anchored in the ratchet arms 20 and 24, and 60 and 62, respectively. By using this type of alternative arrangement, the angle pins 30 and 54 would have oscillatory rotary motion which would drive the ratchet arms 20, 24, 60 and 62. Also in this alternative embodiment, the ratchet pins 28 and 52 would be stationary and prevent rotary motion of the piston. This may be the most desirable embodiment if the ratio between longitudinal motion and rotary motion is not adjustable. This could also eliminate complexity in the structure of the piston 32.

I claim:

1. A motor for converting longitudinal motion to rotary motion comprising:

a housing having a first and a second end;

drive shaft means extending into said first end of said housing toward said second end of said housing;

piston means inside said housing, said piston means reciprocating longitudinally between said first and second ends of said housing;

ratchet means including ratchet pin means extending through said piston means and clutch means connecting said ratchet pin means to said drive shaft means;

angle pin means anchored in said first and said second end of said housing, said angle pin means being at an angle with respect to said ratchet pin means, either said ratchet pin means or said angle pin means being parallel to said drive shaft means; and power means for causing longitudinally reciprocating motion of said piston means, said angle causing said piston means to have a first oscillatory rotary motion as said piston means reciprocates longitudinally, said first oscillatory rotary motion of said piston means causing a second oscillatory rotary motion of said ratchet means which drives said drive shaft means via said clutch means in one rotary direction.

2. The motor for converting longitudinal motion to rotary motion as recited in claim 1 wherein said ratchet pin means is parallel to said drive shaft means, said angle pin means includes adjustment means at one end thereof to vary said angle which varies a ratio between rotary motion of said drive shaft means and longitudinal motion of said piston means.

3. The motor for converting longitudinal motion to rotary motion as recited in claim 1 wherein said ratchet means includes at least two ratchet pin means both extending through said piston means parallel to said drive shaft means and at least two clutch means connecting said ratchet pin means to said drive shaft means so that rotary motion is applied to said drive shaft means during each direction of said longitudinally reciprocating motion of said piston means.

4. The motor for converting longitudinal motion to rotary motion as recited in claim 3 wherein said angle pin means includes at least two angle pins, a first angle pin causing oscillatory rotary motion of first of said ratchet pin means and a second angle pin causing oscillatory rotary motion of second of said ratchet pin means.

5. The motor for converting longitudinal motion to rotary motion as recited in claim 4 wherein said piston means has at least two layers longitudinally reciprocating together but rotating in opposing directions, a first layer causing oscillatory rotary motion of said first ratchet pin means via said first angle pin and a second layer causing oscillatory rotary action of said second ratchet pin means via said second angle pin.

6. The motor for converting longitudinal motion into rotary motion as recited in claim 5 wherein said first and second layers of said piston means have enlarged openings therein to prevent interference from said first and second ratchet pin means and said first and second angle pins.

7. The motor for converting longitudinal motion to rotary motion as recited in claim 6 wherein said piston means includes a third layer, said third layer being connected to said first layer by cylindrical sleeve means which prevents binding with said housing, said second layer being free to rotate opposite and between said first and third layers, said third layer having enlarged openings to prevent interference with said angle pin means and said second ratchet pin means.

8. The motor for converting longitudinal motion to rotary motion as recited in claims 1, 2 or 6 wherein said piston means includes pivotal socket means for receiving said angle pin means therethrough.

9. The motor for converting longitudinal motion to rotary motion as recited in claims 1 or 7 wherein said clutch means is a sprague type clutch.

10. The motor for converting longitudinal motion to rotary motion as recited in claim 2 wherein said piston means has at least three layers, said layers having slots for receiving socket means therein, said socket means receiving said angle pin means therethrough and having flange means to slideably seal said slots upon changing said angle by said adjustment means.

11. The motor for converting longitudinal motion to rotary motion as recited in claim 10 wherein said slots for said layers are staggered to prevent leakage across said piston means, said flange means covering said slots upon said socket means being radially changed in said slots by said adjustment means.

* * * * *